United States Patent [19]

Verhoeven et al.

[11] Patent Number: 4,577,401

[45] Date of Patent: Mar. 25, 1986

[54] PROCESS AND APPARATUS FOR SEPARATING A SUSPENSION BAR FROM AN ELECTRODE

[75] Inventors: Constant T. Verhoeven, Poederlee; Hubert J. Tobback, Lichtaart; John M. Dompas, Olen, all of Belgium

[73] Assignee: Metallurgie Hoboken-Overpelt, Hoboken, Belgium

[21] Appl. No.: 520,209

[22] PCT Filed: Dec. 22, 1982

[86] PCT No.: PCT/BE82/00025

§ 371 Date: Aug. 4, 1983

§ 102(e) Date: Aug. 4, 1983

[87] PCT Pub. No.: WO83/02289

PCT Pub. Date: Jul. 7, 1983

[30] Foreign Application Priority Data

Dec. 24, 1981 [LU] Luxembourg ..... 83857

[51] Int. Cl.[4] ..... H01R 43/00; B23P 19/00

[52] U.S. Cl. ..... 29/825; 29/762; 148/1; 414/771

[58] Field of Search ..... 29/825, 762; 198/477, 198/680; 414/226, 763, 771, 783; 148/1; 118/500

[56] References Cited

U.S. PATENT DOCUMENTS

| | | | |
|---|---|---|---|
| 2,944,655 | 7/1960 | Griswold | 198/680 X |
| 3,198,669 | 8/1965 | Pickering et al. | 414/771 X |
| 3,479,721 | 11/1969 | Wennberg | 29/211 |
| 3,499,207 | 4/1970 | Sasaki | 29/241 |

*Primary Examiner*—Mark Rosenbaum
*Assistant Examiner*—Carl J. Arbes
*Attorney, Agent, or Firm*—Pennie & Edmonds

[57] ABSTRACT

Process and apparatus for separating a suspension bar (14) from an electrode (11) that is vertically suspended by this bar and that comprises, besides this bar, an electrolytic plate (12) and one or several suspension loops (13) fastened to the plate, the suspension bar extending through these loops.

The suspension bar (14) is first relieved of the weight of the plate (12) by bringing the electrode (11) in a horizontal position in which its plate (12) is caused to rest on a support (34 or 34').

The position of the bar (14) is then changed with regard to the position of the plate (12) by moving the support (34 or 34') with the plate (12) in a direction parallel to the longitudinal axis of the bar (14) while retaining the latter.

15 Claims, 16 Drawing Figures

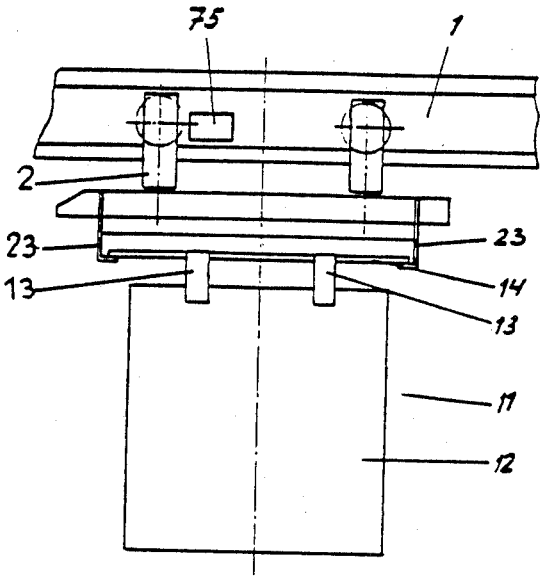
FIG. 3
FIG. 4
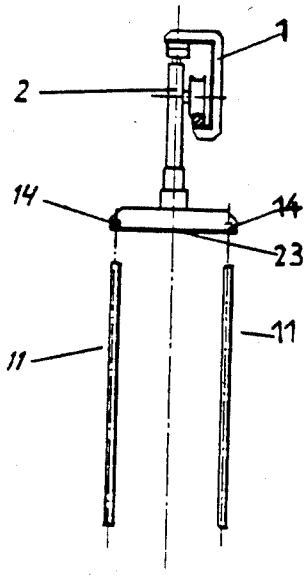
FIG. 6
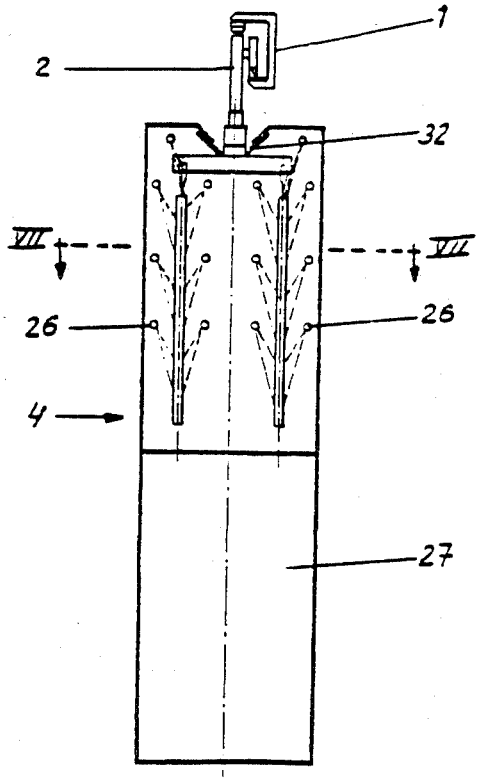

FIG. 16
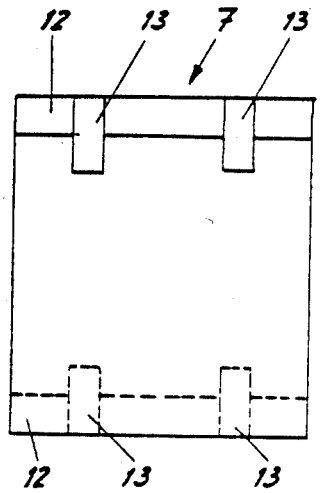
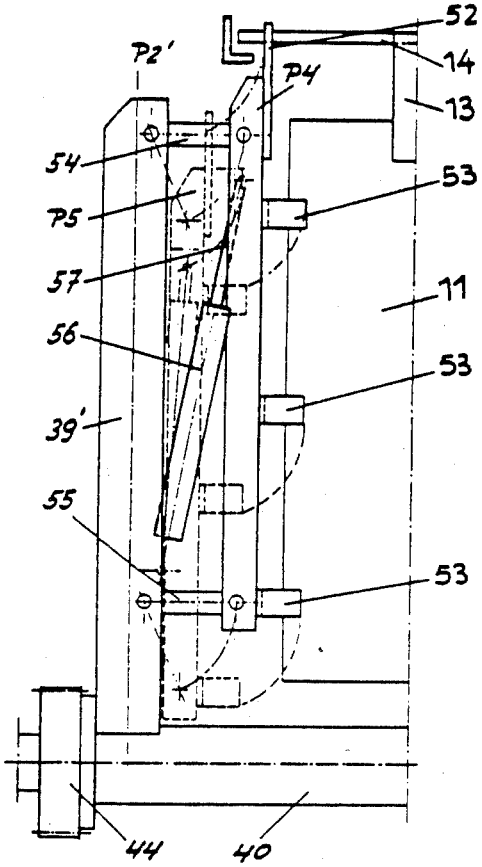
FIG. 11
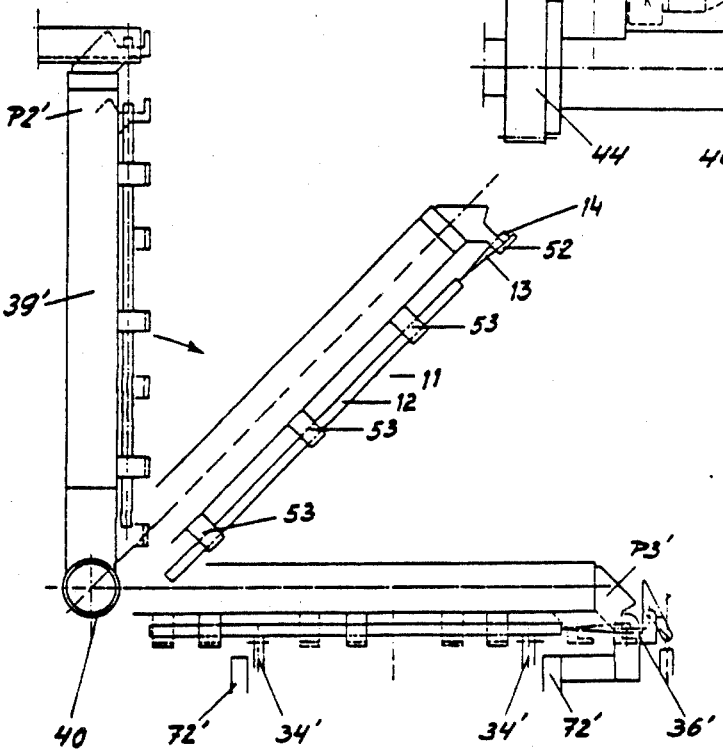
FIG 12

PROCESS AND APPARATUS FOR SEPARATING A SUSPENSION BAR FROM AN ELECTRODE

TECHNICAL FIELD

The present invention relates to a process for separating a suspension bar from an electrode that is vertically suspended by this bar and that comprises, besides this bar, an electrolytic plate and one or several suspension loops fastened to the plate, the suspension bar extending through these loops, according to which the suspension bar is first relieved of the weight of the plate by causing the latter to rest on a support and then the position of the bar is changed with regard to the position of the plate so as to separate the bar from the rest of the electrode.

BACKGROUND ART

A similar process is described in U.S. Pat. No. 3,499,207. In this known process, in order to relieve the suspension bar of the weight of the plate, the electrode is brought from the vertical position into an inclined position and it is kept in this position by causing the upper part of the electrode, i.e. the suspension loops, the suspension bar and the upper part of the electrolytic plate, to rest against an inclined face of an upper support element and by causing the lower edge of the electrolytic plate to rest on a lower supporting element. In order to change afterwards the position of the bar with regard to the position of the plate, the bar is set moving by striking on one of its ends by means of a striking device, mounted on one side of said inclined face and it is kept moving by means of an extracting roller mounted on the other side of said inclined face. While moving the bar is supported by said extracting roller and by several support rollers mounted on the inclined face between the striking device and the extracting roller. When the suspension bar is separated in this way from the rest of the electrode, the lower support is caused to turn and the electrode deprived of its suspension bar falls on an evacuating conveyor.

In order that this known process leads to the expected result, namely the separation of the bar from the rest of the electrode, it is necessary that, when the electrode reaches said inclined position, the suspension bar is engaged with the extracting roller and that it exposes one of its ends to the striking device. Now, it may happen that at that moment the suspension bar is not engaged with the extracting roller and/or does not expose one of its ends to the striking device, for instance, when the lower edge of the electrolytic plate, which rests on the lower support element and which is supposed to be smooth, is deformed by electrolytic incrustations, or when for any reason the suspension loops of the electrode, which are supposed to have the same length, have a substantially different length, or even when for any reason the height of the electrolytic plate, which is supposed to be always the same, differs substantially from the normal height. Hence, this known process lacks reliability, since at the moment the suspension bar is relieved of the weight of the plate, the position of this suspension bar can vary substantially from one electrode to the other.

The aim of the present invention is to provide a process as defined before that avoids the drawback of the aforesaid known process.

SUMMARY OF THE INVENTION

According to the invention, in order to relieve the suspension bar of the weight of the plate, the electrode is brought from its vertical position into a substantially horizontal position, in which its plate is caused to rest on the support, and, while the electrode is brought to the substantially horizontal position, it is kept suspended by its suspension bar so that this bar occupies a predetermined position at the moment the plate is caused to rest on the support and the electrode is hence no longer suspended by its bar. In doing so, one can then change the position of the bar with regard to the position of the plate in the best conditions, whatever the state of the lower edge of the plate, the length of the suspension loops and the height of the plate may be.

In order to change the position of the bar with regard to the position of the plate, it is advantageous to retain the bar while moving the support with the plate parallelly to the longitudinal axis of the bar, which allows to form easily very stable piles with the electrodes, from which the suspension bars were separated, as will be explained further on.

The bar is preferably retained by one of its ends while the support with the plate is moved so as to cause the latter to pass before the other end of the bar.

After having deposited the plate on the support and before moving the support with the plate, it is very useful to cause the suspension bar to turn a determined angle around its longitudinal axis. Should the bar adhere to the suspension loops, it would in this way be loosened from these loops.

The present invention relates also to an apparatus for separating a suspension bar from an electrode that is vertically suspended by this bar and that comprises, besides this bar, an electrolytic plate and one or several suspension loops fastened to the plate, the suspension bar extending through these loops, comprising a support, means for depositing the plate of the electrode on this support so as to relieve the suspension bar of the weight of the plate, and means for changing the position of the bar with regard to the position of the plate, when the latter has been deposited on the support, so as to separate the bar from the rest of the electrode.

Such apparatus is described in said patent U.S. Pat. No. 3,499,207. This known apparatus does not allow to realize the afore defined process of invention.

The apparatus according to the invention that enables to realize this process is characterized in that the means for depositing the plate of the electrode on the support are adapted to bring the electrode in a substantially horizontal position and comprise means for sustaining the suspension bar of the electrode so that this bar occupies a predetermined position at the moment the plate is deposited on the support.

BRIEF DESCRIPTION OF THE DRAWINGS

Other details and characteristics of the invention will appear from the description, given hereafter as a non-restrictive example and with reference to the enclosed drawings, of a process and apparatus for washing and stacking cathodes, i.e. electrodes provided with a suspension bar, comprising an embodiment of the process and apparatus according to the invention, wherein:

FIG. 3 represents an elevational lateral view of a device for conveying cathodes in the installation of FIG. 1.

FIG. 4 represents a front view of the device of FIG. 3.

FIG. 6 represents a transversal section through the washing station of FIG. 5.

FIG. 11 shows the unhooking of a cathode from the conveying device of FIG. 3 in the stacking preparation station of FIG. 10.

FIG. 12 shows the depositing of an unhooked cathode in the stacking preparation station of FIG. 10.

FIG. 16 shows the way in which the cathodes are stacked near the outlet of the stacking preparation station of FIG. 8.

DETAILED DESCRIPTION OF THE PREFERRED EMBODIMENTS

The same reference notations indicate identical elements in the different figures.

Figure 1:
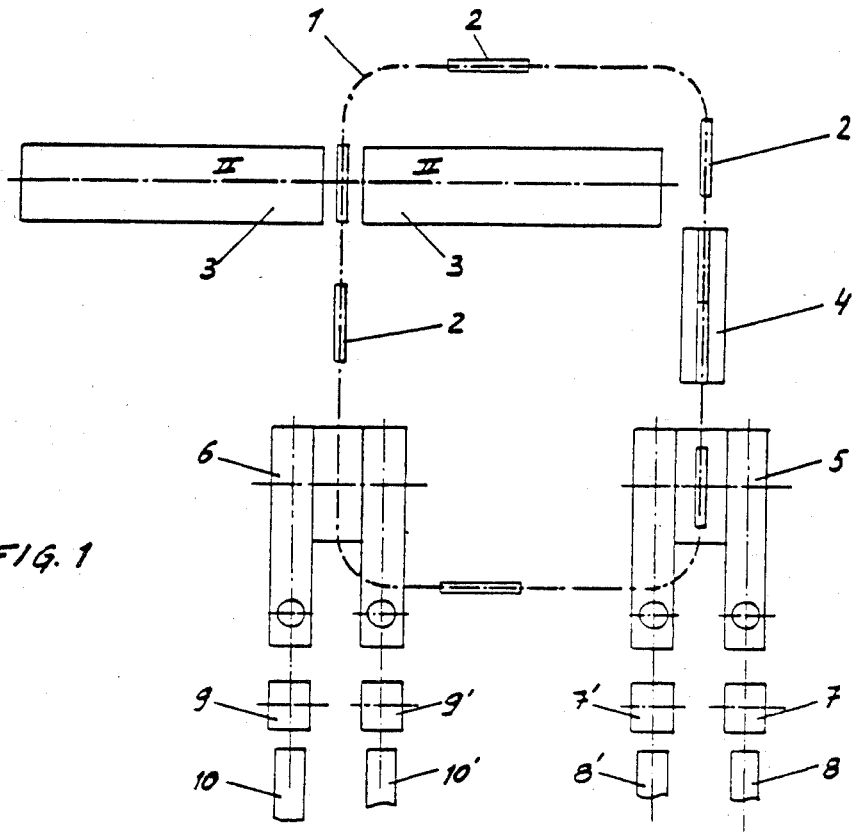
FIG. 1 represents a schematic plan view of an installation for washing and stacking cathodes, comprising an apparatus according to the invention for depriving the cathodes of their suspension bar after their washing and before their stacking.

The installation represented on FIG. 1 comprises an endless monorail 1, provided with a number of carriages 2 that are individually driven and controlled. Monorail 1 serves successively:

a loading station 3, in which a pair of cathodes to be washed are suspended to the carriages 2, a washing station 4, in which the cathodes suspended to carriages 2 are washed by sprinkling, a first stacking preparation station 5, in which the washed cathodes are removed from carriages 2, deposited on a conveyor, deprived of their suspension bar and turned, and a second stacking preparation station 6, which starts operating when the first station 5 has a breakdown.

Cathodes prepared for stacking in station 5 are stacked in 7 and 7′ and the piles that are formed are carried off in 8 and 8′. Cathodes prepared for stacking in station 6 are stacked in 9 and 9′ and the piles that are formed are carried off in 10 and 10′.

As shown on FIG. 3, a cathode 11 consists of a metal plate 12 provided with two suspension loops 13 through which extends a suspension bar 14.

Figure 2:
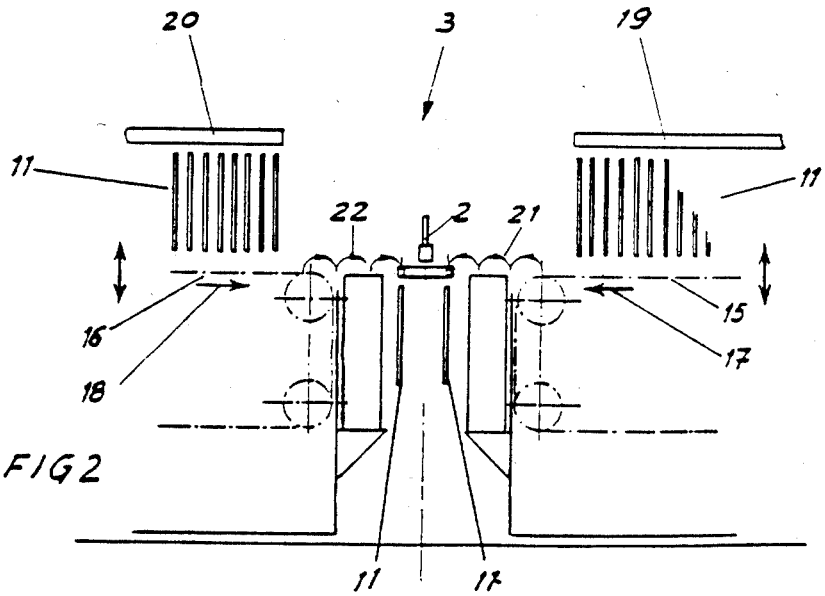
FIG. 2 represents an enlarged vertical section through the installation of FIG. 1, made along line II—II of FIG. 1.

Loading station 3, shown on FIG. 2, comprises two pairs of conveying chains 15 and 16 provided with a non-represented motor driving the chains step by step in the direction indicated by arrows 17 and 18′. Cathodes 11 to be washed coming from the tankhouse are deposited in groups by racks 19 and 20 on the pairs of chains 15 and 16, which bring cathodes 11 to the walking beam transfer devices 21 and 22. The latter lift cathodes 11 one by one from chains 15 and 16 and suspend them on the hooks 23 of a carriage 2 (see FIGS. 3 and 4), which brings them to washing station 4.

Figure 5:
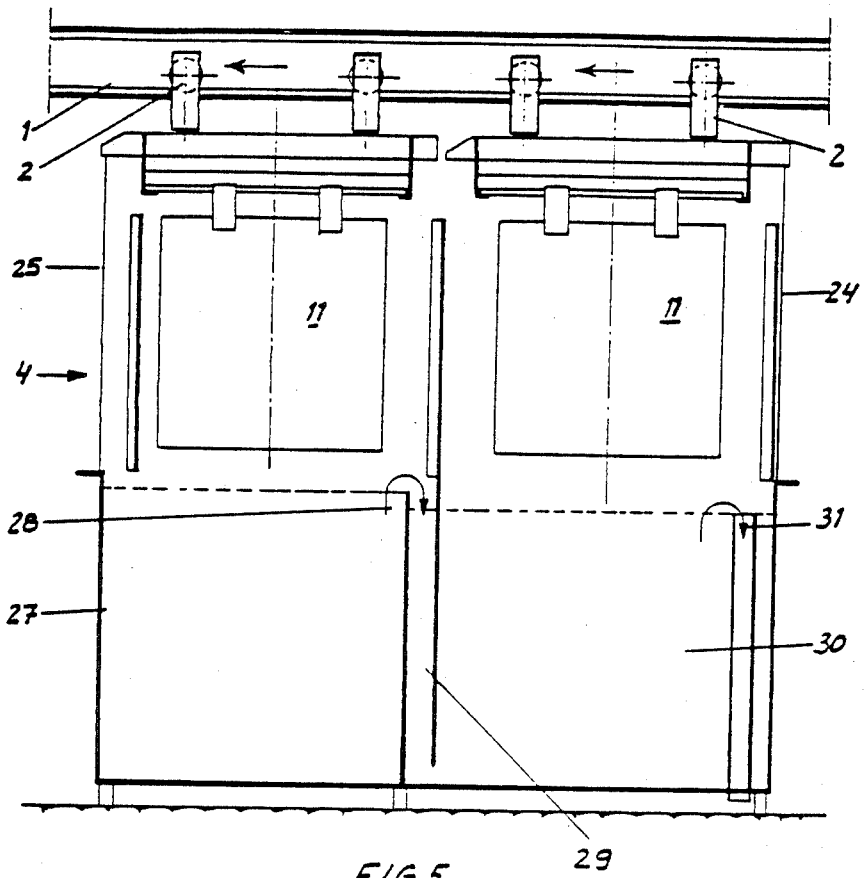
FIG. 5 represents an elevational lateral view of the washing station of the installation of FIG. 1.
Figure 7:
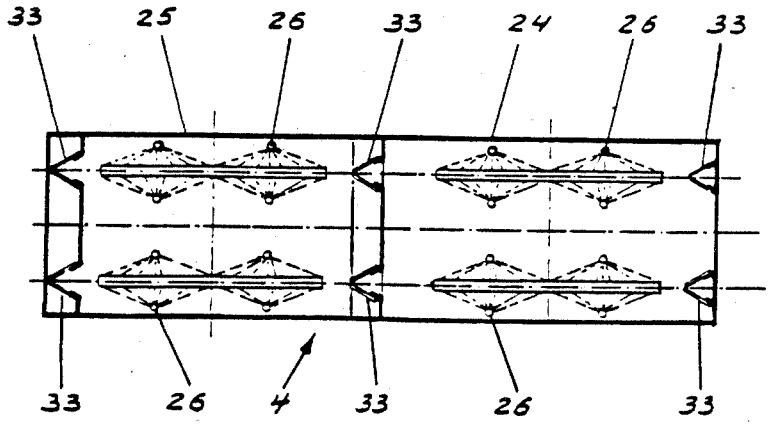
FIG. 7 represents a horizontal section through the washing station of FIG. 6, made along line VII—VII of FIG. 6.

As shown on FIGS. 5 and 7, washing station 4 comprises a washing compartment 24 and a rinsing compartment 25. These compartments 24 and 25 are equipped with a series of sprayers 26 arranged so as to sprinkle both faces of the cathodes 11 that are brought into these compartments by carriage 2 (see also FIG. 6). Sprayers 26 of rinsing compartment 25 are connected with a hot water source. The rinsing water produced in rinsing compartment 25 is collected in tank 27, from where it overflows in 28 to reach via syphon 29 tank 30, which is connected through a non-represented pump with sprayers 26 of washing compartment 24 and which collects the wash water produced in this compartment. Tank 30 is provided with a weir 31 and the wash water that overflows at 31 is drained off to a neutralization installation. The tightness of compartments 24 and 25 is ensured by pairs of flexible V-shaped elements 32 and 33 (FIGS. 6 and 7).

Figure 8:
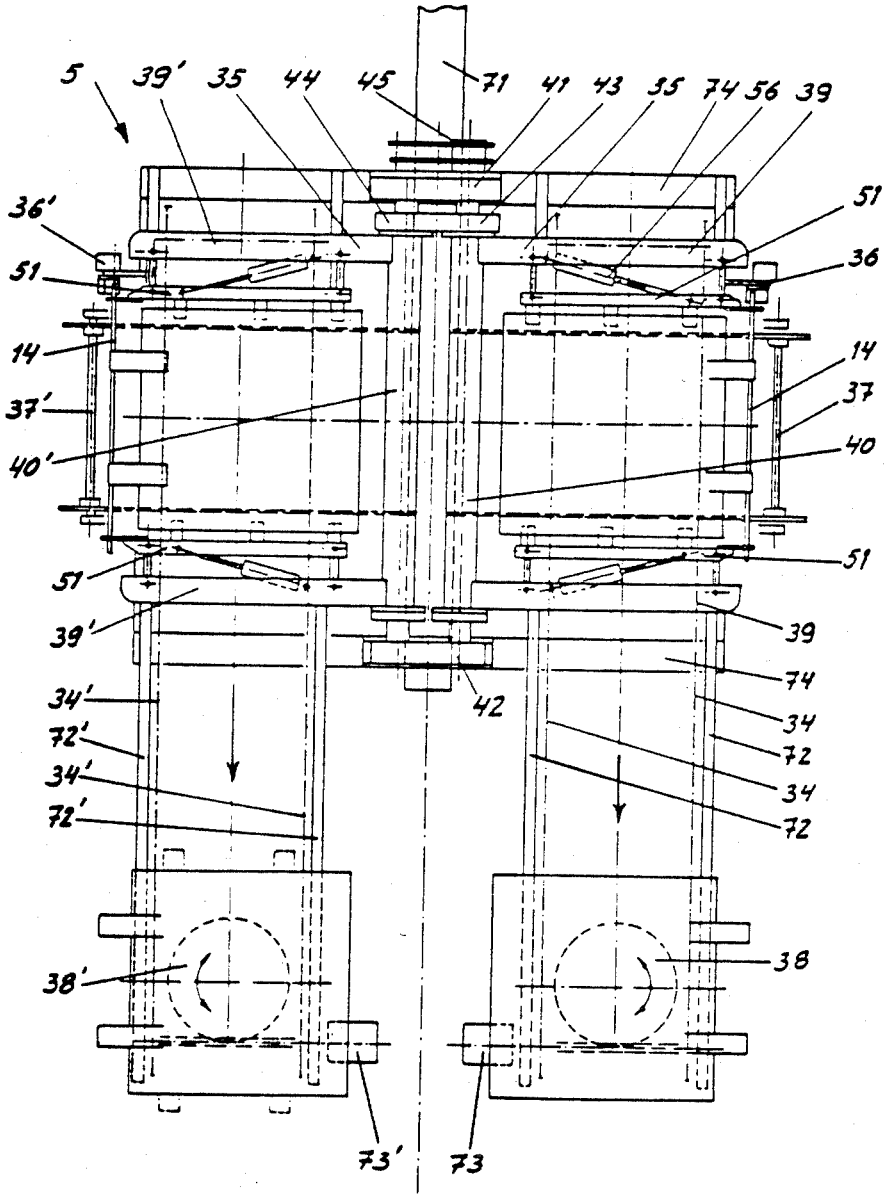
FIG. 8 represents an enlarged and detailed plan-view of a stacking preparation station of the installation of FIG. 1.
Figure 9:
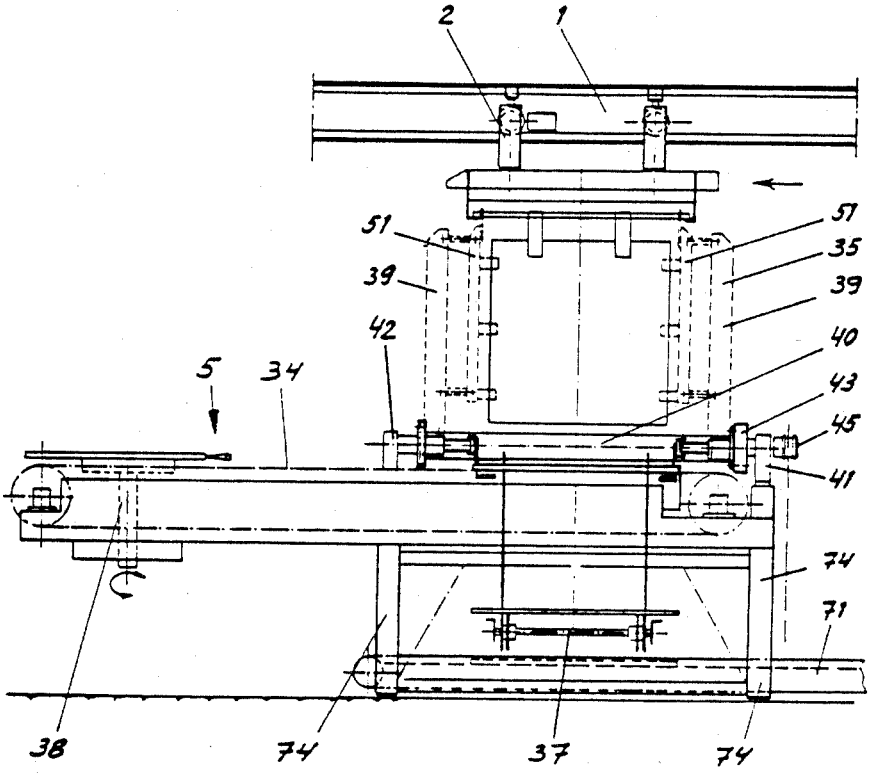
FIG. 9 represents an elevational lateral view of the stacking preparation station of FIG. 8.
Figure 10:
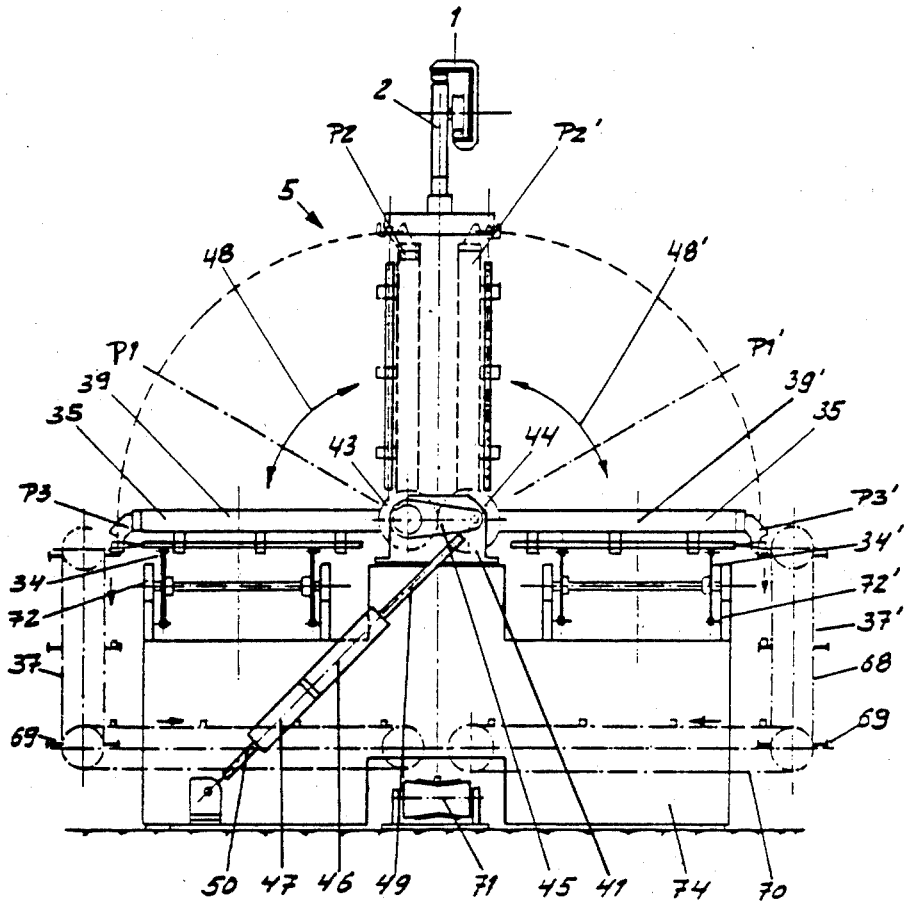
FIG. 10 represents a front view of the entry of the stacking preparation station of FIG. 8.

As shown on FIGS. 8 to 10, stacking preparation station 5 comprises:

two pairs of conveying chains 34 and 34′, an unhooking device 35 for removing a pair of washed cathodes 11 from a carriage 2 and for depositing them horizontally, one on the pair of chains 34 and the other on the pair of chains 34′, two grips 36 and 36′ for depriving cathodes 11 deposited on chains 34 and 34′ of their suspension rod 14, two devices 37 and 37′ for carrying off the suspension bars 14 recovered in 36 and 36′, and two turning tables 38 and 38′ for lifting cathodes 11 deprived of their suspension bar 14 from chains 34 and 34′ and for causing them to turn.

Unhooking device 35 comprises a first pair of arms 39 fastened to a shaft 40 and a second pair of arms 39′ fastened to a shaft 40′. Shafts 40 and 40′ are mounted in bearings 41 and 42, parallelly to the longitudinal axis of suspension bar 14 of cathodes 11 that are brought in station 5 by a carriage 2. Shaft 40 is fastened to a toothed wheel 43 and shaft 40 to a toothed wheel 44 that is in mesh with toothed wheel 43. Toothed wheel 43 is connected with a lever 45 driven by cylinders 46 and 47. Hence, the moving of lever 45 brings about the moving in opposite direction of pairs of arms 39 and 39′ along arrows 48 and 48′ (see FIG. 10). When rod 49 of cylinder 46 is completely out and rod 50 of cylinder 47 is completely in, pairs of arms 39 and 39′ are in inclined waiting positions P1 and P1′. When both rods 49 and 50 are completely in, pairs of arms 39 and 39′ are in vertical cathode gripping positions P2 and P2′. When both rods 49 and 50 are completely out, the pairs of arms are in horizontal depositing positions P3 and P3′.

Each arm 39 and 39′ is provided with a working arm 51, equipped with a lifting hook 52 and three supporting hooks 53 (see FIG. 11). This working arm 51 is connected with its carrier arm 39 or 39′ by two jointed couplings 54 and 55 and by a cylinder 56 that brings the working arm 51 in working position P4, when its rod 57 is pushed out, and back in waiting position P5 when its rod is moved in.

Figure 13:
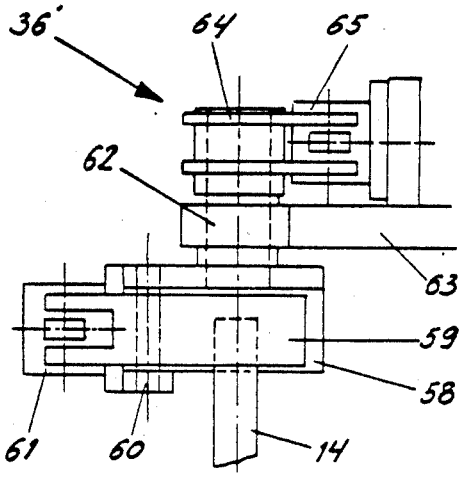
FIG. 13 represents an enlarged and detailed plan view of part of the stacking preparation station of FIG. 8, this part being a pivoting grip for removing the suspension bars from the cathodes.
Figure 14:
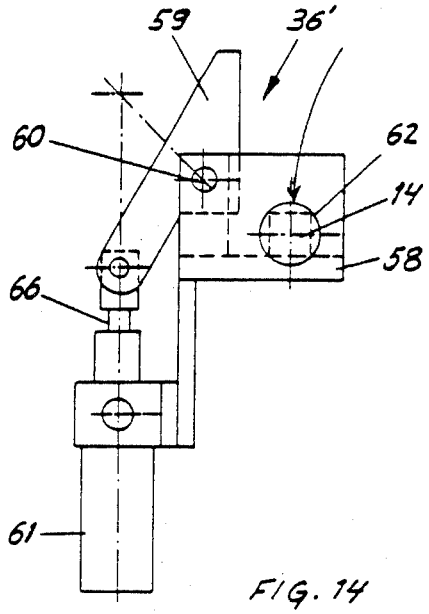
FIG. 14 represents a front view of part of the grip of FIG. 13 in loading position.
Figure 15:
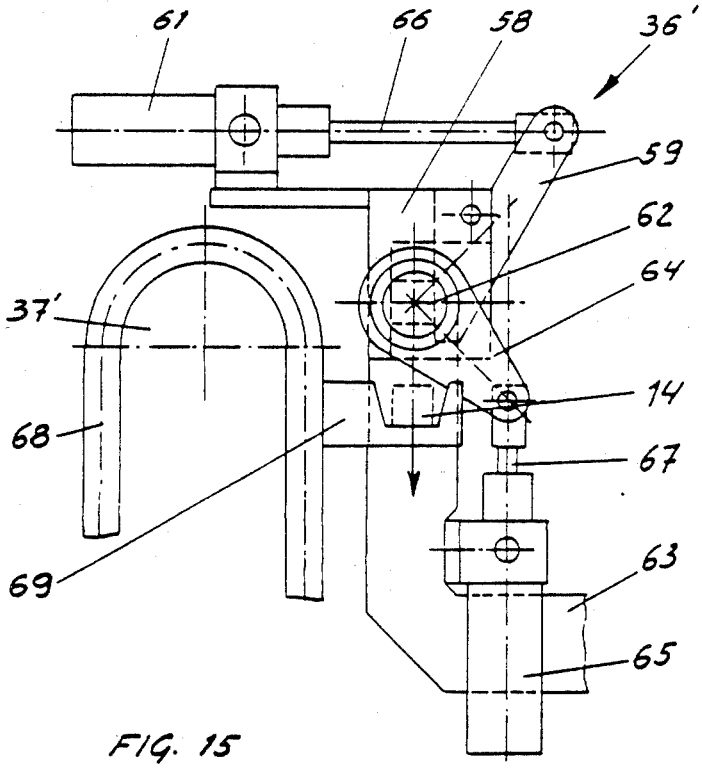
FIG. 15 represents a front view of the grip of FIG. 13 in unloading position.

As shown on FIGS. 13 to 15, grip 36′ comprises a fixed jaw 58 and a mobile jaw 59, connected with fixed jaw 58 by pivot 60 and driven by cylinder 61. Fixed jaw 58, mobile jaw 59 and cylinder 61 are mounted together on a shaft 62 that is mounted in a bearing 63 and fastened to a lever 64. Lever 64 is driven by cylinder 65. When rod 66 of cylinder 61 is completely in, grip 36′ is open (FIG. 14) and when it is completely out, grip 36′ is closed (FIGS. 13 and 15). When rod 67 of cylinder 65 is completely in, grip 36′ is in unloading position (FIG. 15) and when it is completely out, grip 36′ is in loading position (FIGS. 13 and 14). It is obvious that grip 36 is the reflected image of grip 36′.

Device 37′ for evacuating the suspension bars recovered in 36′ comprises a vertical conveyor 68 provided with hooks 69 and an horizontal conveyor 70 leading to a central conveyor 71 (see FIGS. 10 and 15). Device 37 is the reflected image of device 37′.

Pairs of conveying chains 34 and 34′ are mounted on frames 72 and 72′ (see FIGS. 8, 10 and 12) and driven by motors 73 and 73′ causing them to move foreward step by step, parallelly to the longitudinal axis of suspension bar 14 of cathodes 11 that are brought in station 5 by a carriage 2.

The various parts of stacking preparation station 5, which have been described herebefore, are mounted on a frame 74 (see FIGS. 8, 9 and 10).

The installation of FIG. 1 comprises moreover known but not represented detection devices for detecting the arrival of an empty carriage 2 at loading station 3 and the arrival of a loaded carriage 2 at washing compartment 24, at rinsing compartment 25, at the first stacking preparation station 5 and at the second stacking preparation station 6; the detection device of the latter station starts operating only when first station 5 has a breakdown. When a carriage 2 is detected by one of these detection devices, its motor 75 (see FIG. 2) stops for a predetermined time T, for instance for 5 seconds.

The apparatus operates as follows. When an empty carriage 2 is detected at loading station 3, it stops and transfer devices 21 and 22 start operating and suspend a pair of cathodes 11 to carriage 2. After a time T, the loaded carriage 2 leaves loading station 3 and goes to washing station 4. When the loaded carriage 2 is detected at washing compartment 24, it stops and sprayers 26 of this compartment start operating. After a time T, sprayers 26 stop operating and carriage 2 passes to rinsing compartment 25. When carriage 2 is detected at rinsing compartment 25, it stops and sprayers 26 of this compartment start operating. After a time T, sprayers 26 of rinsing compartment 25 stop operating and carriage 2 passes to stacking preparation station 5. When carriage 2 is detected at station 5, above unhooking device 35 that is at that moment in waiting position P1—P1′, carriage 2 stops and rod 49 of cylinder 46 is moved in, thereby bringing pairs of arms 39 and 39′ in their gripping position P2 and P2′. When pairs of arms 39 and 39′ are detected in positions P2 and P2′ by a known and not represented detecting device, rods 57 of cylinders 56 are pushed out, thereby bringing working arms 51 from their waiting position P5 to their working position P4, in which they lift the cathodes 11 from carriage 2 (see FIG. 11). Now, rod 49 of cylinder 46 and rod 50 of cylinder 47 are pushed out, thereby bringing pairs of arms 39 and 39′ that each carry a cathode 11, from their gripping position P2—P2′ to their depositing position P3—P3′, in which plate 12 of the cathode 11 carried by pair of arms 39 is deposited on chains 34 and one end of the suspension bar 14 of this cathode on the fixed jaw of grip 36 and in which plate 12 of the cathode 11 carried by pair of arms 39′ is deposited on chains 34′ and one end of the suspension bar 14 of this cathode on the fixed jaw 58 of grip 36′ (see FIGS. 12 and 14). During the passage of arms 39 and 39′ from positions P2—P2′ to positions P3—P3′, cathodes 11 remain suspended by their suspension bar 14 on hooks 52 while their plates 12 rest on hooks 53 until plates 12 are deposited on chains 34—34′ (see FIG. 12). Since cathodes 11 are kept suspended by their suspension bar 14 until the moment they are deposited, this suspension bar occupies always the same position at said moment; in that position bar 14 is, in the present case, oriented as it was at the moment cathode 11 was still vertically suspended at at carriage 2 in station 5. When pairs of arms 39 and 39′ are detected in positions P3 and P3′ by a known and not represented detecting device, rods 57 of cylinders 56 are moved in, thereby bringing working arms 51 back in their waiting position P5 and then rod 50 of cylinder 47 is moved in, thereby bringing pairs of arms 39 and 39′ back in their waiting position P1—P1′. The detection of pairs of arms 39 and 39′ in P3 and P3′ starts also the clamping of suspension bars 14 of cathodes 11 by grips 36 and 36′: rods 66 of cylinders 61 are pushed out and grips 36 and 36′ are closing. When the closing of grips 36 and 36′ is detected by a known and not represented detection device, rods 67 of cylinders 65 are moved in and grips 36 and 36′ pass from their loading position (FIGS. 13 and 14) in their unloading position (FIG. 15). Suspension bars 14 are thus turned 90° around their longitudinal axis, thereby loosening them from suspension loops 13 in case they should adhere to these loops. When grips 36 and 36′ are detected in their unloading position, motors 73 and 73′ of conveying chains 34 and 34′ bring cathodes 11 above turning tables 38 and 38′. Cathodes 11 are in this way deprived of their suspension bars, which are clamped in 36 and 36′. When cathodes 11 are detected above turning tables 38 and 38′, rods 66 of cylinders 61 are moved in, grips 36 and 36′ open and suspension bars 14 fall on a hook 69 of the vertical conveyors 68 of devices 37 and 37′, which convey bars 14 via central conveyor 71 to an apparatus for producing starting cathodes. Then rods 67 of cylinders 65 are pushed out and grips 36 and 36′ are brought back to their loading position (FIG. 14).

At the detection of cathodes 11 above turning tables 38 and 38′, chains 34 and 34′ stop and tables 38 and 38′ lift the cathodes 11 and turn them 90° alternately clockwise and anticlockwise. Cathodes 11 are then lifted from tables 38 and 38′ by means of a known and not represented device and stacked respectively in 7 and 7′. Very stable piles are obtained as shown on FIG. 16.

The loaded carriage 2 that had stopped in station 5 has started again unloaded after a time T to pass again to loading station 3.

Hereinbefore a description was given of the washing and stacking of symmetrical cathodes, i.e. cathodes, the suspension bar of which has an identical section over its whole length. It is known that in electrolysis also asymmetrical cathodes are used, i.e. cathodes with a suspension bar, one end of which is twisted 90° with regard to the rest of the bar and that these cathodes are then used in groups of left cathodes and in groups of right cathodes, a left cathode having the twisted end of its suspension bar at the left side of its electrolytic plate and a right cathode having the twisted end of its suspension bar at the right side of its electrolytic plate. It is clear that a left cathode can be converted into a right cathode, for instance by causing it to turn 180° around its vertical axis and vice versa. If asymmetrical cathodes have to be treated in the before described installation, one shall take care that the twisted end of the suspension bars shall be clamped by grip 36 or 36'. Hence, the installation shown at FIG. 9 is suitable to treat right cathodes, grip 36 being located at the right side of the deposited cathode (see FIG. 8). In order that above described installation is able to treat asymmetrical cathodes, the left cathode groups should previously be converted into right groups. It is also possible, however, to adapt the installation of FIG. 9 in such a way that it can treat both left cathodes and right cathodes. To this end, one can mount a second grip at the left side of the deposited cathode, extend pair of chains 34 to the right, modify the driving system of these chains so as to enable them to move also to the right and install also a turning table 38 on the right wing of pair of chains 34. The right grip 36 and the left grip have to be mounted so that they can be brought from a rest position remote from chains 34 into a work position near to chains 34 and vice versa. The left grip and the right wing of pair of chains 34 are then used for treating a left group of cathodes and the right grip 36 and left wing of pair of chains 34 for treating a right group of cathodes.

It should be understood that the afore described installation can be modified in many other ways without interfering with its essence.

So, for instance, second stacking preparation station 6 may be omitted, but this modification decreases of course the flexibility of the installation.

The installation can be easily adapted to treat cathode per cathode instead of two cathodes at a time. This modification decreases sensibly the investment costs, but also the productiveness of the installation.

Instead of providing washing station 4 with a separated washing 24 and rinsing compartment 25, one single compartment can be used for washing and rinsing, provided that this single compartment is equipped with washing and rinsing sprayers or with sprayers adapted to sprinkle alternately a washing and rinsing liquid.

Monorail 1 and carriages 2 may be replaced by a conveying chain provided with hooks, but this modification reduces seriously the flexibility of the installation.

Pivoting grips 36 and 36' may be replaced by fixed grips, if the suspension bars of the cathodes to be treated have but little or no tendency to adhere to the suspension loops of these cathodes.

Chains 34 and 34' may be provided with cams in order to facilitate the conveying of cathodes 11 by these chains.

It is obvious that the afore described installation can be easily converted into an installation for washing and stacking anode scrap, anodes being electrodes consisting of a metal plate provided with two suspension lugs. Therefor it is enough to omit grips 36 and 36', since the anodes have no suspension bar.

We claim:

1. In an electrode comprising an electrolytic plate having one or more suspension loops attached to the plate and a suspension bar extending through the loops for vertical support of the plate, a method for separating the bar from the loops of the plate which comprises moving the plate from a vertical position to a substantially horizontal position; positioning the plate on support means thereby relieving the weight of the plate on the bar; and removing the bar from the loops of the plate while the plate is in contact with the support means.

2. The method according to claim 1 wherein the bar is removed from the suspension loops of the plate by retaining the bar in a fixed position with respect to the position of the loops of the plate when the plate is initially positioned on the support means and thereafter moving the support means and plate in a direction parallel to the longitudinal axis of the bar.

3. The method according to claim 2 wherein the bar is retained in the fixed position by fixing one end of the bar before the support and plate are moved.

4. The method according to claim 2 which further comprises rotating the bar through a predetermined angle around its longitudinal axis after the plate has been placed on the support means and before the support means and plate are moved.

5. The method according to claim 4 wherein the predetermined angle is about 90°.

6. In an electrode comprising an electrolytic plate having one or more suspension loops attached to the plate and a suspension bar extending through the loops for vertical suspension of the plate, a process for separating the bar from the loops of the plate which comprises: moving the plate from a vertical position to a substantially horizontal position; positioning the plate on support means thereby relieving the weight of the plate on the bar; rotating the bar through a predetermined angle around its longitudinal axis; and removing the bar from the loops of the plate by holding one end of the bar to retain the bar in a fixed position and thereafter moving the support means and plate in a direction parallel to the longitudinal axis of the bar.

7. In an electrode comprising an electrolytic plate having one or more suspension loops attached to the plate and a suspension bar having an longitudinal axis extending through the loops for vertical support of the plate, an apparatus for separating the bar from the loops of the plate comprising means for moving the plate from a vertical position to a substantially horizontal position; means operatively associated with the moving means for supporting the plate in the horizontal position to relieve the weight of the plate on the bar; and means operatively associated with the support means for removing the bar from the loops of the plate while the plate is in contact with the support means.

8. The apparatus according to claim 7 wherein the means for removing the bar from the loops of the plate comprises means for retaining the bar in a fixed position with respect to the position of the loops of the plate when the plate is initially positioned on the support means and means operatively associated with the retaining means for moving the support means and plate in a direction parallel to the longitudinal axis of the bar.

9. The apparatus according to claim 8 wherein the means for retaining the bar comprises gripping means.

10. An apparatus according to claim 7 further comprising means operatively associated with the support means for rotating the bar through a predetermined angle around its longitudinal axis while the plate is in contact with the support means and before the bar is removed from the loops of the plate.

11. In an electrode comprising an electrolytic plate having one or more suspension loops attached to the plate and a suspension bar having a longitudinal axis extending through the loops for vertical support of the plate, an apparatus for separating the bar from the loops of the plate comprising means for moving the plate from a vertical position to a substantially horizontal position; means operatively associated with the moving means for supporting the plate in the horizontal position to relieve the weight of the plate on the bar; means for removing the bar from the loops of the plate while the plate is in contact with the support means, the removing means comprising means for gripping one end of the bar to retain the bar in a fixed position with respect to the position of the loops of the plate when the plate is initially positioned on the support means and means for moving the support means and plate in a direction parallel to the longitudinal axis of the bar; and means operatively associated with the gripping means for rotating the bar through a predetermined angle around its longitudinal axis while the plate is in contact with the support means but before the support means and plate are moved.

12. The apparatus according to claim 11 wherein the support means comprises the upper run of an endless conveyer which moves parallel to the longitudinal axis of the bar.

13. The apparatus according to claim 11 wherein the means for moving the plate from a vertical position to a substantially horizontal position comprises a shaft mounted on bearings parallel to the longitudinal axis of the suspension bar in its initial position; a pair of supporting arms connected to the shaft; drive means for rotating the shaft and moving the supporting arms from an inclined waiting position to a vertical position for gripping the electrode and from the vertical position through the inclined waiting position to a horizontal depositing position and further from this horizontal position back to the inclined waiting position; a working arm for each supporting arm, each working arm comprising an electrode lifting hook and at least one supporting hook for the plate, the working arm being connected to its respective supporting arm by jointed couplings; and drive means for moving the working arms from a waiting position to a working position and back, said waiting and working positions being such that when the working arms move from the waiting position to the working position, with the support arms in the vertical gripping position, the lifting hooks lift the electrode to be treated by the suspension bar, and, when the supporting arms pass from the vertical gripping position to the horizontal depositing position with the working arms in the working position, the suspension bar remains supported by the lifting hooks and the plate is supported by the supporting hooks.

14. The apparatus according to claim 11 wherein the means for gripping the bar comprises a grip having a fixed jaw adapted to support one end of the bar and a mobile jaw adapted to exert pressure on the same end of the bar, and wherein the means for rotating the bar comprises means for rotating the grip around the longitudinal axis of the bar.

15. In an electrode comprising an electrolytic plate having one or more suspension loops attached to the plate and a suspension bar having a longitudinal axis extending through the loops for vertical support of the plate, an apparatus for separating the bar from the loops of the plate comprising: a shaft mounted on bearings parallel to the longitudinal axis of the suspension bar in its initial position; a pair of supporting arms connected to the shaft; drive means for rotating the shaft and moving the supporting arms from an inclined waiting position to a vertical position for gripping the electrode and from the vertical position through the inclined waiting position to a horizontal depositing position and further from this horizontal position back to the inclined waiting position; a working arm for each supporting arm, each working arm comprising an electrode lifting hook and at least one supporting hook for the plate, the working arm being connected to its respective supporting arm by jointed couplings; and drive means for moving the working arms from a waiting position to a working position and back, said waiting and working positions being such that when the working arms move from the waiting position to the working position, with the support arms in the vertical gripping position, the lifting hooks lift the electrode to be treated by the suspension bar, and, when the supporting arms pass from the vertical gripping position to the horizontal depositing position with the working arms in the working position, the suspension bar remains supported by the lifting hooks and the plate is supported by the supporting hooks; an endless conveyor which moves parallel to the longitudinal axis of the bar for supporting the plate in a horizontal position; means for removing the bar from the loops of the plate while the plate is in contact with the endless conveyor, the removing means comprising a grip having a fixed jaw adapted to support one end of the bar and a mobile jaw adapted to exert pressure on the same end of the bar to retain it in position; means for moving the endless conveyor and plate in a direction parallel to the longitudinal axis of the bar; and means for rotating the bar through a predetermined angle while the plate is in contact with the endless conveyor but before the bar is removed from the loops of the plate, the rotating means comprising means for rotating the grip around the longitudinal axis of the bar.

* * * * *